US006886603B2

(12) United States Patent
Uchida et al.

(10) Patent No.: US 6,886,603 B2
(45) Date of Patent: May 3, 2005

(54) METHOD FOR MANUFACTURING SOLID STRUCTURAL MATERIAL AND FOUNDATION FABRIC THEREFOR

(75) Inventors: Hiroshi Uchida, Oumihachiman (JP); Shigeru Nishiyama, Aichi-Ken (JP); Masahiro Shinya, Aichi-Ken (JP)

(73) Assignees: Mitsubishi Heavy Industries, Ltd., Tokyo (JP); Murata Kikai Kabushiki Kaisha, Kyoto (JP)

( * ) Notice: Subject to any disclaimer, the term of this patent is extended or adjusted under 35 U.S.C. 154(b) by 79 days.

(21) Appl. No.: 10/040,450

(22) Filed: Jan. 9, 2002

(65) Prior Publication Data

US 2002/0056484 A1 May 16, 2002

Related U.S. Application Data

(62) Division of application No. 09/571,320, filed on May 15, 2000, now Pat. No. 6,470,916.

(30) Foreign Application Priority Data

Jun. 10, 1999 (JP) ..... 11-163619

(51) Int. Cl.[7] ..... D03D 41/00

(52) U.S. Cl. ..... 139/11; 139/DIG. 1; 139/383 R; 139/389; 442/205

(58) Field of Search ..... 139/DIG. 1, 11, 139/383 R, 387 R, 384 R, 389, 388; 442/205

(56) References Cited

U.S. PATENT DOCUMENTS

| | | | | | |
|---|---|---|---|---|---|
| 4,958,663 | A | * | 9/1990 | Miller et al. | 139/384 R |
| 5,080,142 | A | * | 1/1992 | Calamito et al. | 139/384 R |
| 5,085,252 | A | * | 2/1992 | Mohamed et al. | 139/22 |
| 5,100,713 | A | * | 3/1992 | Homma et al. | 428/102 |
| 5,228,481 | A | * | 7/1993 | Kimbara et al. | 139/11 |
| 5,785,094 | A | * | 7/1998 | Yoshida | 139/384 R |

FOREIGN PATENT DOCUMENTS

| | | |
|---|---|---|
| JP | 10-325041 | 12/1998 |

* cited by examiner

*Primary Examiner*—Katherine Moran
*Assistant Examiner*—Robert H. Muromoto
(74) *Attorney, Agent, or Firm*—Westerman, Hattori, Daniels & Adrian, LLP

(57) ABSTRACT

A method for manufacturing solid structural material using a three-dimensional five-axial woven fabric. In weaving a three-dimensional five-axial woven fabric W using a three-dimensional weaving machine, divisibly woven sections are formed in portions of a manufactured three-dimensional five-axial woven fabric by alternately driving an upper and a lower insertion members for inserting a vertical yarn from above and below, respectively, in such a manner that each of the insertion members and a weft insertion rapier are driven with different timings.

2 Claims, 6 Drawing Sheets

METHOD FOR MANUFACTURING SOLID STRUCTURAL MATERIAL AND FOUNDATION FABRIC THEREFOR

This application is a division of prior application Ser. No. 09/571,320 filed May 15, 2000 now U.S. Pat. No. 6,470,916.

BACKGROUND OF THE INVENTION

1. Field of the Invention

The present invention relates to a method for manufacturing a solid structural material using a three-dimensional five-axial woven fabric and a foundation fabric for use in this method.

2. Description of the Related Art

Three-dimensional weaving machines for weaving three-dimensional five-axial woven fabrics are well known. These weaving machines are described, for example, in Japanese Patent Application Laid Open (Tokkai-Hei) No. 3-76845, Japanese Patent Application Laid Open (Tokkai-Hei) No. 4-11043 and in Japanese Patent Application Laid Open (Tokkai-Hei) No. 5-106140. As described in each of these publications, the three-dimensional weaving machine guides warps and bias yams to a cloth fell and inserts vertical yarns into the cloth fell from above or below a yarn layer. Further, a weft insertion rapier inserts wefts into the yarn layer to allow the vertical yarns to connect the warps, the wefts, and the bias yarns together, thereby manufacturing a three-dimensional five-axial woven fabric.

Such three-dimensional five-axial woven fabrics are expected to be applied to various fields in the future.

The present invention is provided to expand the application of three-dimensional five-axial woven fabrics, and it is an object thereof to manufacture a solid structural material using a three-dimensional five-axial woven fabric.

SUMMARY OF THE INVENTION

The present invention weaves a three-dimensional five-axial woven fabric using a three-dimensional weaving machine, a solid structural material is manufactured by alternately driving upper and lower insertion members for inserting vertical yarns from above and below, respectively, in such a manner that each of the insertion members and a weft insertion rapier are driven with different timings, thereby forming divisibly woven sections in portions of a manufactured three-dimensional five-axial woven fabric.

The divisibly woven sections can be formed in a longitudinal direction of the three-dimensional five-axial woven fabric by selectively driving each of the insertion members in a cross direction of the three-dimensional five-axial woven fabric in such a manner that a particular insertion member and the weft insertion rapier are driven with different timings.

The present invention also provides a foundation fabric for use in manufacturing a solid structural material, comprising a three-dimensional five-axial woven fabric having a divisibly woven sections in portions thereof.

DETAILED DESCRIPTION OF THE PREFERRED EMBODIMENTS

An embodiment of the present invention will be described below

Figure 1:
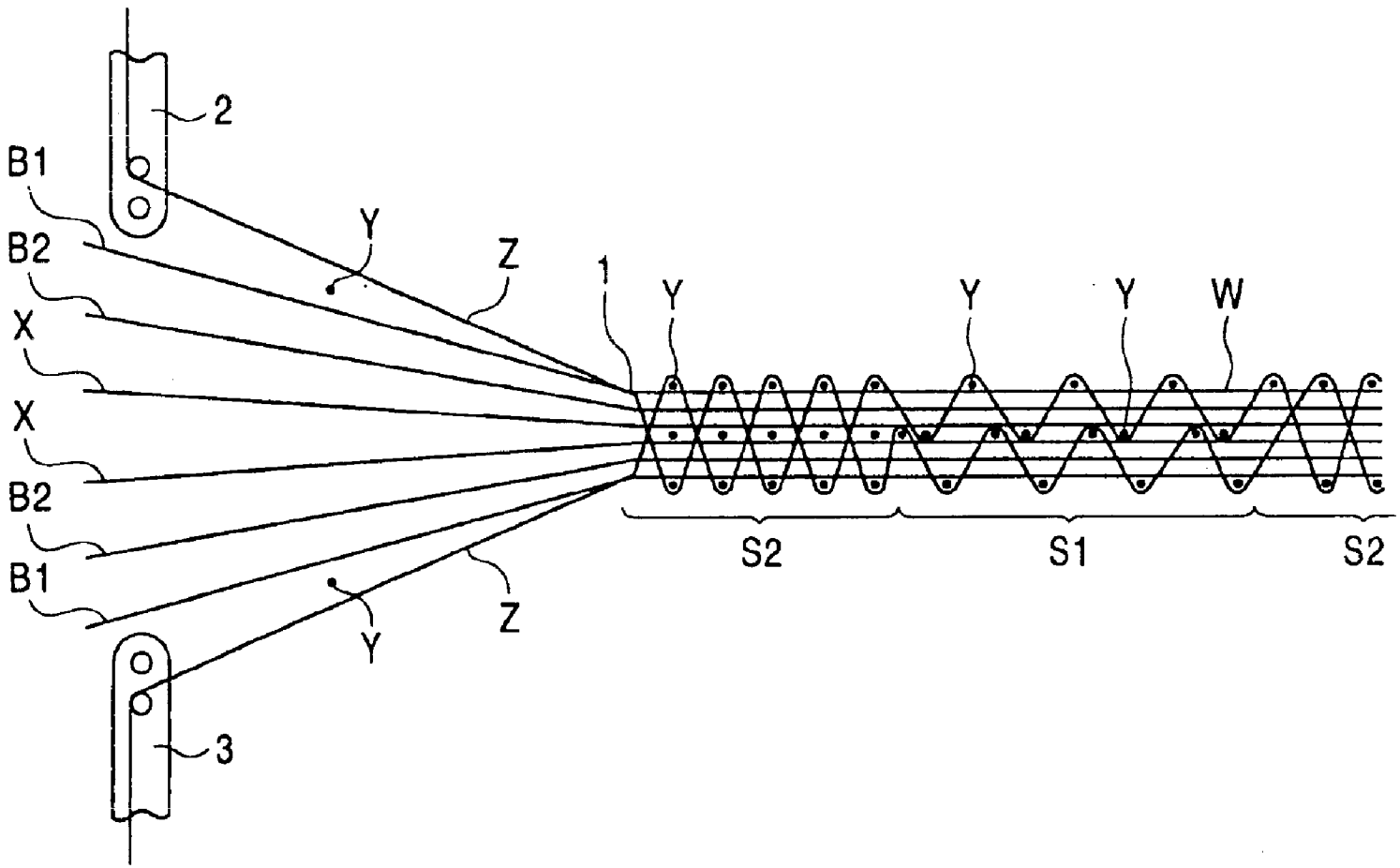
FIG. 1 is an explanatory drawing showing an embodiment of the present invention.

FIG. 1 shows a three-dimensional weaving machine for weaving a three-dimensional five-axial woven fabric W. As in conventional three-dimensional weaving machines, in this three-dimensional weaving machine, warps X and bias yarns B1, B2 pass through a bias yarn orientation device and is then guided to a cloth fell 1, where the warps X are formed into a plurality of yarn sublayers.

Further, the bias yarns B1, B2 are formed into sets of two yarn sublayers each in such a manner that these yarn layers are located at opposite sides of the layers of the warps X. In each of these sets of two yarn sublayers each, the bias yarn orientation device operates the bias yarns B1, B2 to incline the bias yarn B1 in one of the two sublayers through +45 dgrees relative to the warps X, while inclining the bias yarn B2 in the other sublayer through −45 dgrees relative to the warps X, as in the conventional three-dimensional weaving machine.

Furthermore, according to this three-dimensional weaving machine, a weft insertion rapier inserts wefts Y, and in connection with this insertion, a vertical yarn Z is inserted into each of the yarn layer of the warp X and bias yarns B1, B2 from above or below it. According to this embodiment, a plurality of plate-like upper insertion members 2 are used to insert the vertical yarns Z from above the yarn layer and are each arranged in a cross direction of the three-dimensional five-axial woven fabric W so that the plurality of vertical yarns Z can be guided to each insertion member 2. Likewise, a plurality of plate-like lower insertion members 3 are used to insert the vertical yarns Z from below the yarn layer and are each arranged in a cross direction of the three-dimensional five-axial woven fabric W so that the plurality of vertical yarns Z can be guided to each insertion member 3.

Figure 8:
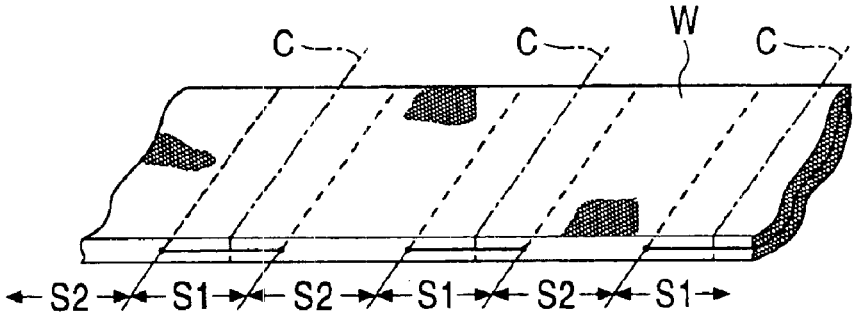
FIG. 8 is a perspective view of the three-dimensional five-axial woven fabric in FIG. 1.
Figure 9:
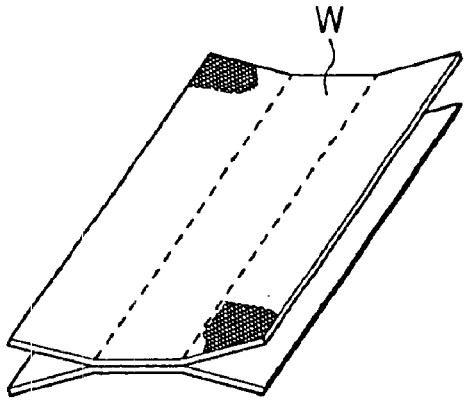
FIG. 9 is a perspective view showing a state in which the three-dimensional five-axial woven fabric in FIG. 8 is cut open.
Figure 10:
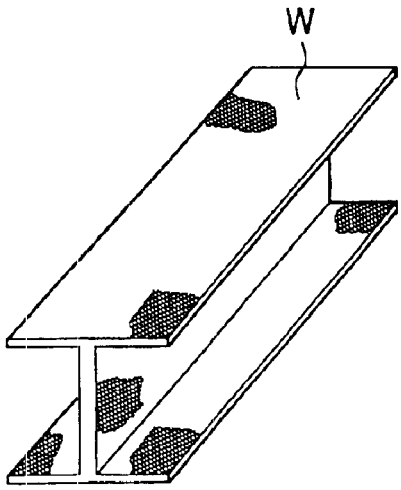
FIG. 10 is a perspective view showing a manufactured I beam.

The upper and lower insertion members 2, 3 are alternately driven in such a manner that each of the insertion members 2, 3 and the weft insertion rapier are driven with different timings, thereby forming divisibly woven sections S1 in portions of the manufactured three-dimensional five-axial woven fabric W. For example, as shown in FIG. 8, a plurality of divisibly woven sections S1 are formed in the cross direction of the three-dimensional five-axial woven fabric W, and the divisibly woven sections S1 and integrally woven sections S2 are alternately formed in a longitudinal direction of the three-dimensional five-axial woven fabric W. The details will be explained below.

Figure 2:
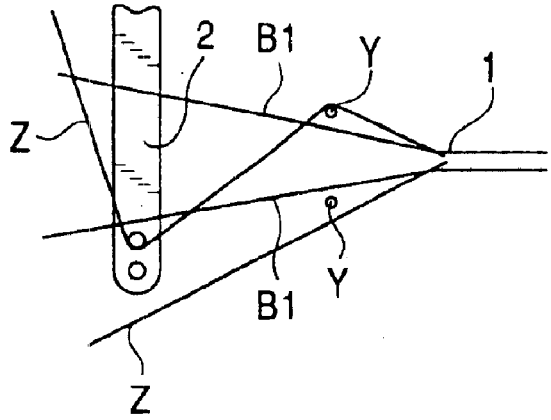
FIG. 2 is an explanatory drawing showing a weaving step carried out by the three-dimensional weaving machine in FIG. 1.
Figure 3:
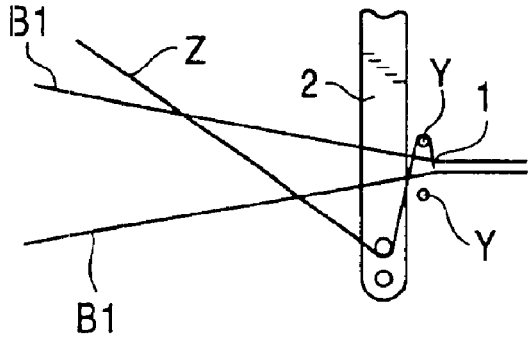
FIG. 3 is an explanatory drawing showing a step following the one in FIG. 2.
Figure 4:
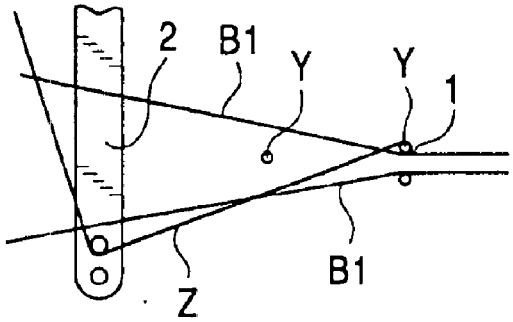
FIG. 4 is an explanatory drawing showing a step following the one in FIG. 3.
Figure 5:
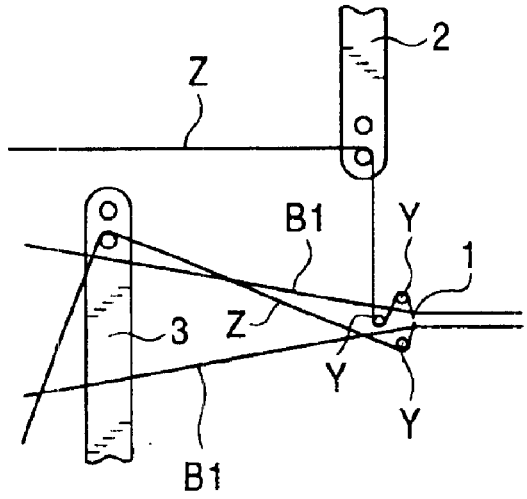
FIG. 5 is an explanatory drawing showing a step following the one in FIG. 4.

Before insertion of the vertical yarns Z, the weft insertion rapier is driven to insert each of two wefts Y into the outside of the corresponding yarn sublayer of the bias yarns B1, B2. Then, as shown in FIG. 2, in each yarn layer, the upper insertion member 2 passes between the bias yarns B1 and B2, between the warps X, and then between the bias yarns B1 and B2 and then lowers to insert the vertical yarn Z from above the yarn layer. Further, as shown in FIG. 3, the upper insertion member 2 moves toward the cloth fell 1 and then beating is performed by the upper insertion member 2. Subsequently, as shown in FIG. 4, the upper insertion member 2 recedes from the cloth fell 1, and one weft Y is inserted between the yarn sublayers of the warps X. Subsequently, as shown in FIG. 5, the upper insertion member 2 moves toward the cloth fell 1, and subsequently beating is done by the upper insertion member 2, and then the upper insertion member 2 moves upward from the yarn layer. Then, the upper insertion member 2 is removed from the yarn layer. Thus, the vertical yarn Z crosses the weft Y in the upper part of the yarn layer, and the vertical yarn Z crosses the weft Y between the yarn-sublayers of the warps X so as to connect the wefts Y together.

Figure 6:
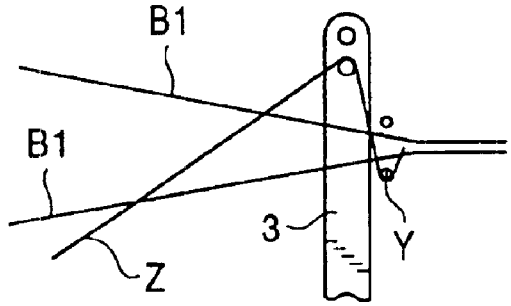
FIG. 6 is an explanatory drawing showing a step following the one in FIG. 5.
Figure 7:
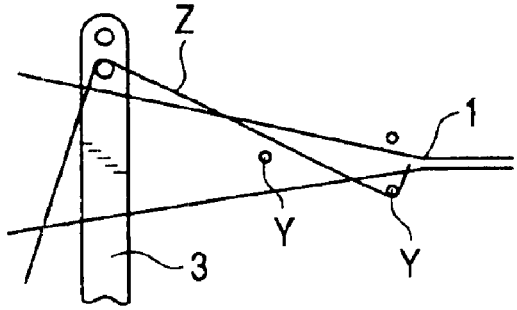
FIG. 7 is an explanatory drawing showing a step following the one in FIG. 6.

Further, simultaneously with the elevation of the upper insertion member 2 from the yarn layer, in each yarn layer, the lower insertion member 3 passes between the bias yarns B1 and B2, between the warps X, and then between the bias yarns B1 and B2 and then elevates to insert the vertical yarn Z from below the yarn layer. Further, as shown in FIG. 6, the lower insertion member 3 moves toward the cloth fell 1 and then beating is performed by the lower insertion member 3. Subsequently, as shown in FIG. 7, the lower insertion member 3 recedes from the cloth fell 1, and one weft Y is inserted between the yarn sublayers of the warps X. Subsequently, similarly to the upper insertion member 2, the lower insertion member 3 moves toward the cloth fell 1, and subsequently beating is performed by the lower insertion member 3, and then moves downward from the yarn sublayer of the bias layers. Then, the lower insertion member 3 is removed from the yarn layer. Thus, the vertical yarn Z crosses the weft Y in the lower part of the yarn layer, and the vertical yarn Z crosses the weft Y between the yarn sublayers of the warps X so as to connect the wefts Y together.

Subsequently, two wefts Y are each inserted into the outside of the corresponding yarn sublayer of the bias yarns B1, B2, and the upper insertion member 2 lowers again to sequentially repeat a similar process. Consequently, the manufactured three-dimensional five-axial woven fabric W is divided between the yarn sublayers of the warps X, and the divided yarn layers are individually connected together. This process forms the divisibly woven section S1.

Further, after formation of the divisibly woven section S1, two wefts Y are each inserted into the outside of the corresponding yarn sublayer of the bias yarns B1, B2, and one weft Y is inserted between the yarn sublayers of the warps X. Subsequently, the upper insertion member 2 lowers, while simultaneously the lower insertion members 3 elevates, and the vertical yarns Z are inserted into the yarn layer from above and below it. Further, the upper and lower insertion members 2, 3 move toward the cloth fell 1, and subsequently beating is preformed by the upper and lower insertion members 2, 3, and then recede therefrom. Subsequently, two wefts Y are each inserted into the outside of the corresponding yarn sublayer of the bias yarns B1, B2, and one weft Y is inserted between the yarn sublayers of the warps X. The upper and lower insertion members 2, 3 move toward the cloth fell 1, and subsequently beating is performed by the upper and lower insertion members 2,3. Then, the upper insertion member 2 elevates, while simultaneously the lower insertion member 3 lowers, whereby the upper and lower insertion members 2, 3 are removed from the yarn layer. As a result, the vertical yarn Z crosses the weft Y in both the upper and lower parts of the yarn layer so as to connect the wefts Y together.

Subsequently, two wefts Y are each inserted into the outside of the corresponding yarn sublayer of the bias yarns B1, B2, and one weft Y is inserted between the yarn sublayers of the warps X. Again, the upper insertion member 2 lowers, while simultaneously the lower insertion member 3 elevates, to sequentially repeat a similar process. This process forms the integrally woven section S2.

Accordingly, after the three-dimensional five-axial woven fabric W has been manufactured, the divisibly woven section S1 can be cut open along a center line C to manufacture an I beam.

The divisibly woven sections S1 can be formed in a longitudinal direction of the three-dimensional five-axial woven fabric W by selectively driving the insertion members 2, 3 in the cross direction of the three-dimensional five-axial woven fabric W in such a manner that the particular insertion member 2, 3 and the weft insertion rapier are driven with different timings. For example, as shown in FIG. 11, a plurality of divisibly woven sections S1 can be formed in the longitudinal direction of the three-dimensional five-axial woven fabric W, while the divisibly woven sections S1 and the integrally woven sections S2 can alternately be formed in the cross direction of the three-dimensional five-axial woven fabric W.

To achieve this, the following process can be carried out: The insertion members 2, 3 are selectively driven in the cross direction of the three-dimensional five-axial woven fabric W. In the area of the divisibly woven section S1 in FIG. 11, when two wefts Y are each inserted into the outside of the corresponding yarn sublayer of the bias yarns B1, B2, the upper insertion member 2 is lowered toward the yarn layer and the vertical yarn Z is inserted into the yarn layer from above it. Then, after beating and when one weft Y is inserted between the yarn sublayers of the warps X, the upper insertion member 2 is elevated and removed from the yarn layer. Subsequently, when two wefts Y are each inserted into the outside of the corresponding sublayer of the bias yarns B1, B2, the lower insertion member 3 is elevated toward the yarn layer and the vertical yarn Z is inserted thereinto from below it. Then, after beating and when one weft Y is inserted between the yarn sublayers of the warps X, the lower insertion member 3 is lowered and removed from the yarn layer. This process can form the divisibly woven section S1.

On the other hand, in the area of the integrally woven section S2 in FIG. 11, when two wefts Y are each inserted into the outside of the corresponding yarn sublayer of the bias yarns B1, B2 and one weft Y is inserted between the yarn sublayers of the warps X, the upper insertion member 2 is lowered, while simultaneously the lower insertion member 3 is elevated, to insert the vertical yarn Z into the yarn layer from above or below it. Then, after beating, two wefts Y are each inserted into the outside of the corresponding sublayer of the bias yarns B1, B2, and one weft Y is inserted between the yarn sublayers of the warps X. Then, after beating, the insertion member 2 is elevated and the insertion member 3 is lowered in a fashion being removed from the yarn layer. This process can form the integrally woven section S2.

Figure 11:
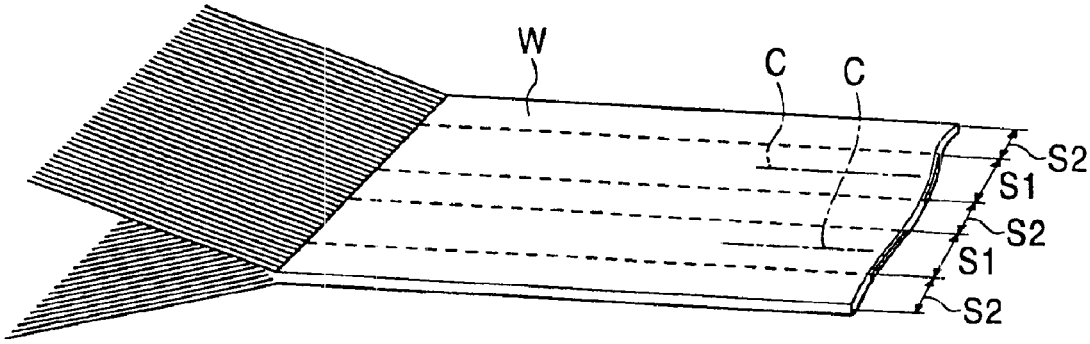
FIG. 11 is a perspective view showing another embodiment.

Accordingly, the divisibly woven section S1 in FIG. 11 can be cut open along the center line C to manufacture the I beam.

Figure 12:
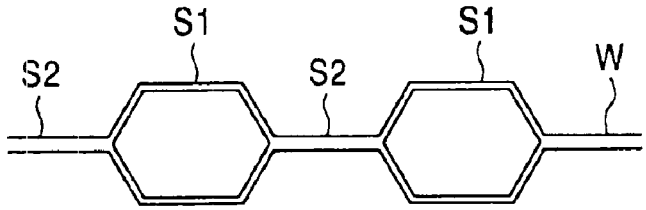
FIG. 12 is an explanatory drawing showing a manufactured hexagonal structural material.
Figure 13:
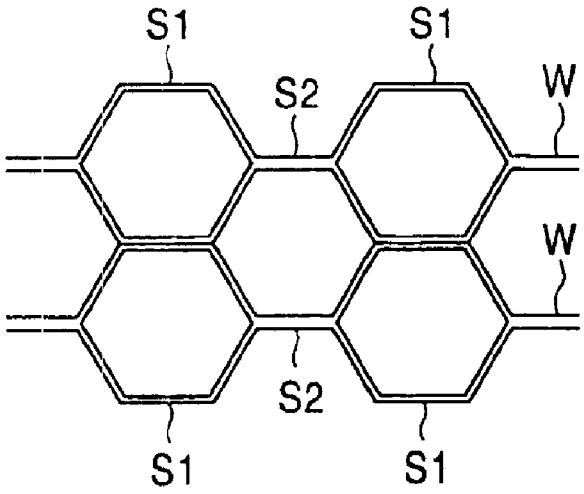
FIG. 13 is an explanatory drawing showing a manufactured honeycomb structural material.
Figure 14:
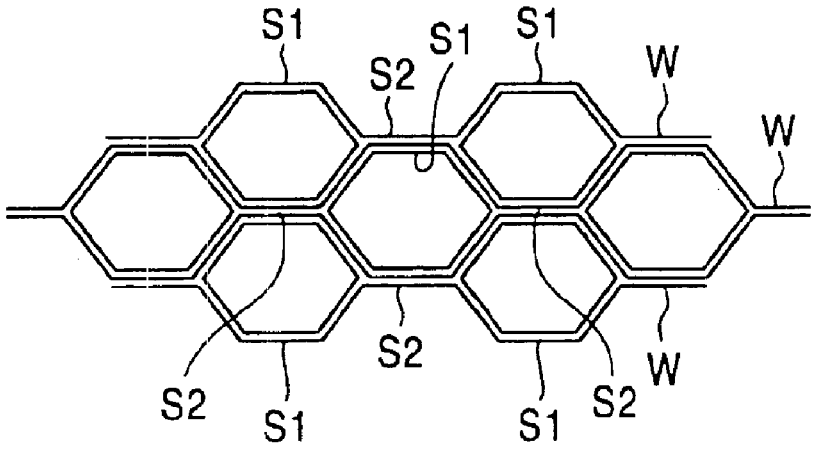
FIG. 14 is an explanatory drawing showing another honeycomb structural material.

In addition to the I beam, other solid structural materials can be manufactured using the divisibly woven section S1 and the integrally woven section S2. For example, a hexagonal structural material can be manufactured using the divisibly woven section S1 and the integrally woven section S2, as shown in FIG. 12. A honeycomb structural material can also be manufactured by sticking together the divisibly woven sections S1 of a plurality of hexagonal structural materials in such a manner that the divisibly woven sections S1 are opposed to one another, as shown in FIG. 13. A honeycomb structural material can also be manufactured by sticking together the divisibly woven sections S1 and integrally woven sections S2 of a plurality of hexagonal structural materials in such a manner that the divisibly woven sections S1 are opposed to the integrally woven sections S2, as shown in FIG. 14.

As described above, according to the present invention, a solid structural material can be manufactured using the three-dimensional five-axial woven fabric W, thereby attaining the intended object.

What is claimed is:

1. An I-beam formed from a three-dimensional five-axial woven fabric, said fabric having at least two divisibly woven sections, and said divisibly woven sections are cut open along a center line to manufacture the I-beam; and wherein, said divisibly woven sections are cut completely through said center line.

2. The I-beam of claim 1, wherein said divisibly woven sections are formed in the longitudinal direction of the three-dimensional five-axial woven fabric and are exposed for cutting.

* * * * *